United States Patent [19]

Yoshizaki

[11] Patent Number: 4,607,600

[45] Date of Patent: Aug. 26, 1986

[54] VALVE ACTUATING APPARATUS IN INTERNAL COMBUSTION ENGINE

[75] Inventor: Kouji Yoshizaki, Susono, Japan

[73] Assignee: Toyota Jidosha Kabushiki Kaisha, Aichi, Japan

[21] Appl. No.: 779,678

[22] Filed: Sep. 24, 1985

[30] Foreign Application Priority Data

| | | | |
|---|---|---|---|
| Dec. 25, 1984 | [JP] | Japan | 59-195438[U] |
| Jan. 11, 1985 | [JP] | Japan | 60-1480[U] |
| Jan. 24, 1985 | [JP] | Japan | 60-7303[U] |

[51] Int. Cl.[4] ..... F02D 13/06

[52] U.S. Cl. ..... 123/90.16; 123/90.27; 123/90.39; 123/90.44; 123/198 F

[58] Field of Search ..... 123/90.15, 90.16, 90.27, 123/90.39, 90.44, 198 F

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters | 123/198 F |
| 4,204,512 | 5/1980 | Brock | 123/90.16 |
| 4,252,093 | 2/1981 | Hazelrigg | 123/198 F |
| 4,380,219 | 4/1983 | Walsh | 123/198 F |
| 4,537,164 | 8/1985 | Ajiki et al. | 123/90.16 |
| 4,556,025 | 12/1985 | Morita | 123/90.16 |

FOREIGN PATENT DOCUMENTS

| | | |
|---|---|---|
| 57-193903 | 12/1982 | Japan . |
| 57-193904 | 12/1982 | Japan . |
| 59-68109 | 5/1984 | Japan . |
| 59-67506 | 5/1984 | Japan . |
| 59-226216 | 12/1984 | Japan . |

*Primary Examiner*—Ira S. Lazarus

*Attorney, Agent, or Firm*—Parkhurst & Oliff

[57] ABSTRACT

A valve actuating apparatus for intake and exhaust valves in an internal combustion engine having a swing rocker arm consisting of two arms rotatably interconnected by means of a connecting shaft, one of the arms being rotatably connected to a rocker arm shaft and the other bearing against a valve stem so that the two arms can selectively occupy an operative position, in which the two arms extend substantially straight to form a single rocker arm, and an inoperative position in which a relative rotation between the two arms takes place to absorb the rotation of the cam. Means are provided for causing the cam to bear only against one of the two arms that bears against the valve stem.

4 Claims, 9 Drawing Figures

VALVE ACTUATING APPARATUS IN INTERNAL COMBUSTION ENGINE

BACKGROUND OF THE INVENTION

1. Field of the Invention

The present invention relates to a valve actuating apparatus for intake and exhaust valves in an internal combustion engine. More particularly, it relates to a valve actuating apparatus which can render only a predetermined intake and/or exhaust valve or valves inoperative at a given engine condition.

2. Description of the Related Art

In a multi-cylinder internal combustion engine, it is known to selectively render only predetermined intake or exhaust valve(s) inoperative in order to cancel out the associated cylinder(s), thereby controlling the total displacement of the effective cylinders, in accordance with the engine load, resulting in the realization of a variable-cylinder internal combustion engine.

Among known valve actuating apparatuses of the kind mentioned above, those closest to the present invention are disclosed, for example, in Japanese Unexamined Utility Model Publication (Kokai) Nos. 59-68109 and 59-67506, in which a rocker arm is divided into two rocker arm elements, one of which bears against a cam and the other bears against a valve stem of the associated intake or exhaust valve. These two arms are interconnected by means of a connecting shaft for relative sliding rotation. The relative sliding rotation takes place between the two arms when only a predetermined intake or exhaust valve is made temporarily inoperative, to absorb the valve lift of the associated valve. The two arms are provided with male and female engaging members which are selectively engaged and disengaged. One of the male and female members can be actuated by an actuator, such as a solenoid means, to selectively occupy locked and unlocked positions.

However, in the known apparatuses mentioned above, there is a possibility that when the associated valve is actuated by the rocker arm, the cam may come into contact with the first arm which is supported by the rocker arm shaft. In this case where the cam comes into contact with the first arm, the rotation of the cam is transmitted first to the first arm and then to the second arm, which bears against the valve stem, by means of the connecting shaft. As a result, a large cam force is exerted on the connecting shaft, and accordingly, a large connecting shaft must be provided and also wear of the connecting shaft is increased by the resultant large frictional force applied thereto.

Furthermore, when the rocker arm is in an inoperative position, in which the two rocker arms are rotated or inclined relative to each other, there is a possibility that the cam will come into partial contact with the first arm. Generally speaking, the second arm, which bears against the valve stem, has a cam contact surface, i.e., an upper surface, which bears against the cam and which is usually subjected to a surface treatment for increasing the friction resistance thereof, such as hardening or quenching, but the upper surface of the first cam is not usually subjected to such a surface treatment; because the first arm comes into partial contact with the cam only when the relative inclination or relative rotation takes place between the two arms of the rocker arm, and accordingly, there is less necessity for a surface treatment of hardening the first arm, in comparison with the second arm, and because it is very difficult to partially harden or quench only the desired portion of the upper surface of the first arm that comes into contact with the cam. Since the surface treatment is expensive, hardening or quenching of entire first arm is not practically acceptable.

Furthermore, in the known apparatuses mentioned above, there is a problem in that the rocker arm tends to interfere with a valve stem of an adjacent valve unit (valve, valve stem, valve retainer, etc.), since the valve units are located very close to each other in a multi-cylinder internal combustion engine. Namely, the first arm of the rocker arm when relatively inclined to the second arm tends to interfere with the valve retainer of an adjacent valve unit. This interference can be solved by decreasing the angular displacement of the first arm (or the second arm).

SUMMARY OF THE INVENTION

The primary object of the present invention is, therefore, to provide a simple valve actuating apparatus having so-called swing type (end pivot type) two divided rocker arms which is free from the aforementioned drawbacks and which can selectively cancel out the operation of the desired intake or exhaust valve(s) without increasing frictional wear on a connecting shaft between the two arms of the rocker arm.

Another object of the present invention is to provide a simple valve actuating apparatus having so-called swing type two divided rocker arms which can prevent interference between the rocker arms and adjacent valve units.

To achieve the object mentioned above, according to the present invention there is provided a valve actuating apparatus for intake and exhaust valves in an internal combustion engine having a swing rocker arm which is rotatably connected at one end to a rocker arm shaft supporting the rocker arm and at its opposite end bears against a valve stem of an associated intake or exhaust valve, and a rotatable cam which is supported on a cam shaft and which bears against the rocker arm to swing the same about the rocker arm shaft, wherein said rocker arm is composed of two arms which are interconnected to each other by means of a connecting shaft extending in parallel to the rocker arm shaft for relative rotation about the connecting shaft, one of which arms bears against the valve stem, so that the two arms can selectively occupy an operative position in which the two arms are integral with each other and extend substantially straight so as to form a single rocker arm, and an inoperative position in which a relative rotation between the two arms takes place to absorb the rotation of the cam, and wherein said apparatus comprises means for causing the cam to bear only against said one arm bearing against the valve stem.

According to another aspect of the invention, the connecting shaft lies in a vertical plane which is spaced from a vertical plane in which the axis of the camshaft lies by a predetermined distance so as to come close to the valve stem.

Other features and objects of the invention will become apparent from the description given below.

BRIEF DESCRIPTION OF THE DRAWINGS

The invention will be described below in detail with reference to the accompanying drawings, which show preferred embodiments of the present invention, and in which.

DESCRIPTION OF THE PREFERRED EMBODIMENTS

Figure 1:
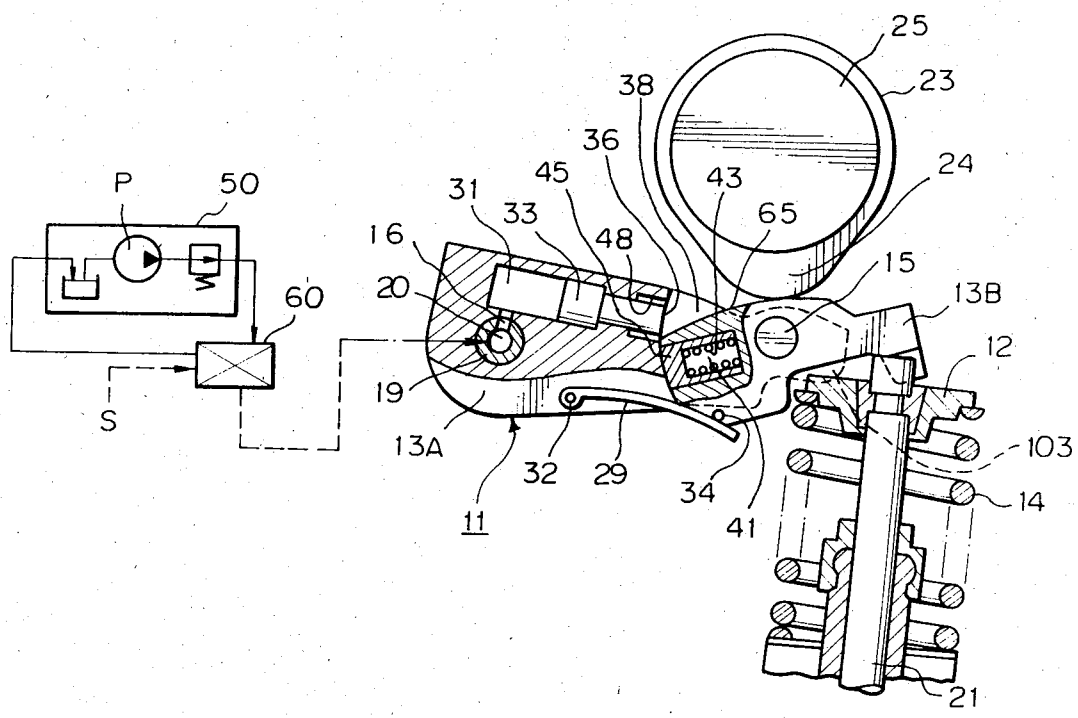
FIG. 1 is a partially sectioned schematic view of a valve actuating apparatus shown in an unlocked, i.e., inoperative position, according to the present invention.

FIGS. 1 to 4 show a first embodiment of the invention, in which a rocker arm 11 consists of two arms, i.e., a first arm 13A which is rotatably connected to a rocker arm shaft 19, and a second arm 13B which is connected to the first arm for relative rotation by means of a connecting shaft 15 and which bears against a top end of a valve stem 21 of an intake or exhaust valve (not shown). This type of rocker arm is known as a swing type or end pivot type, in which the first arm 13A is swingably pivoted to the rocker arm shaft 19. The connecting shaft 15 extends in a direction parallel to the axis of the rocker arm shaft 19 and, accordingly, cam shaft 25, to which a cam 23 is connected so as to rotate therewith.

As is well known, the cam shaft 25 is synchronously rotated by a crank-shaft (not shown) to rotate the cam 23 connected thereon. The cam 23 bears against the rocker arm 11 at an intermediate portion of the latter to actuate the rocker arm. In the illustrated embodiment, the cam 23 bears against the second arm 13B in the vicinity of the connecting shaft 15.

Figure 2:
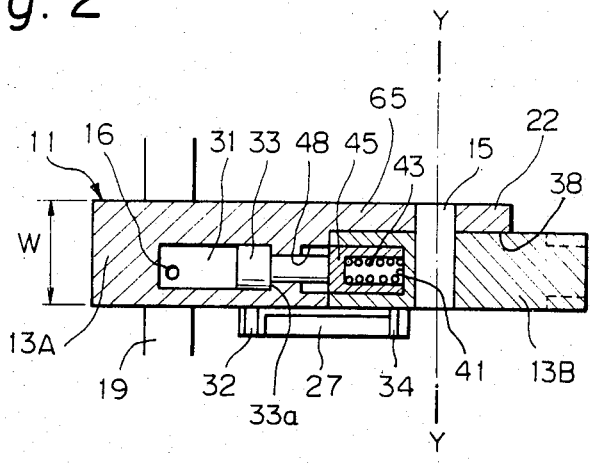
FIG. 2 is an enlarged plan view of a main part of FIG. 1.

The connecting shaft 15 extends through the first and second arms 13A and 13B, which are connected side face to side face for relative sliding rotation about the shaft 15, as can be seen from FIG. 2. The rocker arm 11 can occupy two positions, i.e., an operative position shown in FIGS. 3 and 4 and an inoperative position shown in FIG. 1. In the operative position, the first and second arms 13A and 13B are integral with each other, so that no relative rotation can take place. Namely, the first and second arms 13A and 13B are then equivalent to a conventional single rocker arm, when in the operative position, i.e., locked position as shown in FIGS. 3 and 4.

On the other hand, the first and second arms 13A and 13B can rotate or incline relative to each other when they are in the inoperative position shown in FIG. 1. In the illustrated embodiment, the second arm 13B rotates about the connecting shaft 15 relative to the first arm 13A, so that when the rocker arm 11 is actuated by the cam 23, the first and second arms 13A and 13B are brought into an inclined position in which the second arm 13B largely rotates about the shaft 15 relative to the first arm 13A. In FIGS. 1 and 3, the numerals 12 and 14 designate a retainer mounted to the valve stem 21 and a return spring for the valve, respectively.

Figure 3:
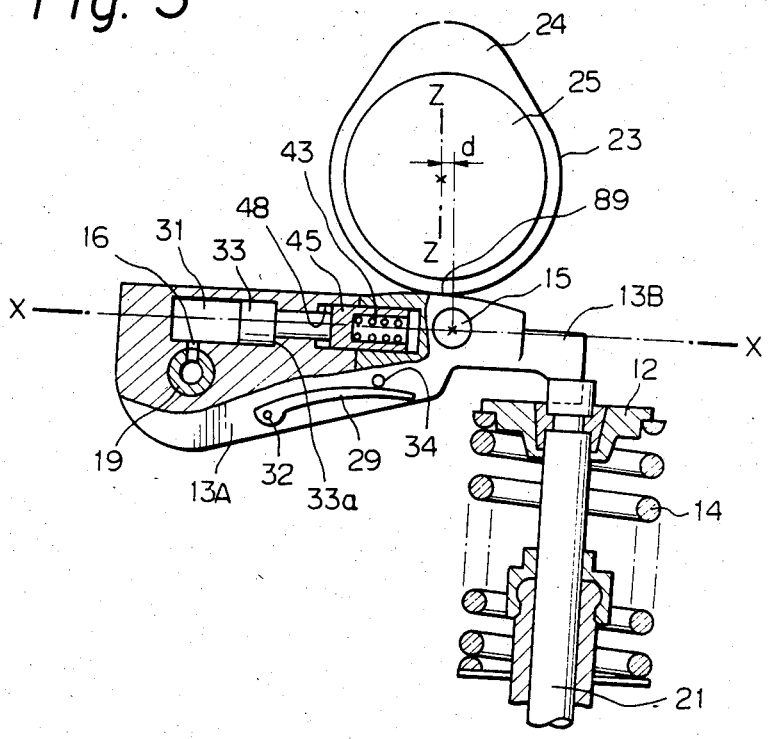
FIG. 3 is a view similar to FIG. 1 but shown in a locked, i.e., operative, position when the valve is in a closed position.
Figure 4:
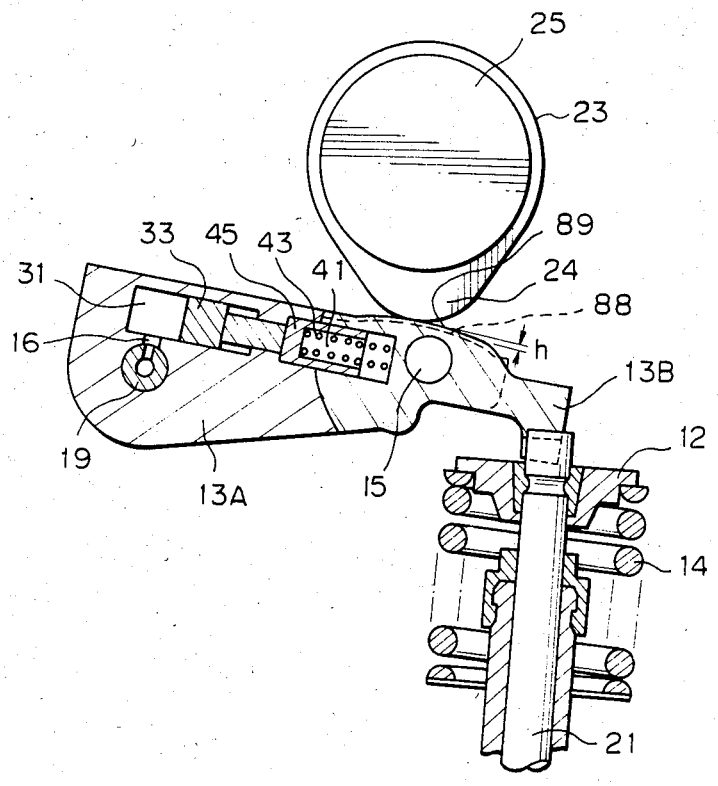
FIG. 4 is a view similar to FIG. 3 but with the valve in an open position.

Between the first and second arms 13A and 13B, is provided a return spring 29 which returns the rocker arm 11, which is located in the inclined position by the cam 23, to the operative position shown in FIGS. 3 and 4 (in which the two arms 13A and 13B extend substantially straight as a single rocker arm) when a cam lobe 24 of the cam 23 separates from the rocker arm 11 during the rotation of the cam 23.

The return spring 29 is made, for example, of a leaf spring connected at one end to a pin 32 provided on the first arm 13A and bearing at the opposite end against a pin 34 provided on the second arm 13B. The return spring is not limited to such a leaf spring and can be a coil spring or the like.

The first and second arms 13A and 13B come into surface contact with each other at a contact surface 38 thereof for relative sliding rotation, as mentioned before. They also are in contact with each other at a curved contact surface 36, which has a radius of curvature substantially identical to an arc of a circle along which the rear end face of the second arm 13B rotates about the shaft 15, so that the second arm 13B can rotate about the shaft 15 while sliding on the curved contact surface 36 of the first arm 13A.

A locking device for preventing the relative rotation of the first and second arms 13A and 13B is provided between the two arms. The locking device is composed of a lock pin 45, which is slidably inserted in a blind hole 41 formed in the second arm 13B by means of a spring 43. The lock pin 45 can be, for example, a movable piston having a generally U-shape section, as shown in FIG. 2. The lock pin 45 is completely retracted in the blind hole 41, which forms a cylinder for the piston 45, in the inoperative position mentioned above. This corresponds to the unlocked position, in which the first and second arms 13A and 13B can rotate relative to each other about the shaft 15.

The lock pin 45 is actuated by an actuator, which is comprised of piston 33 slidably fitted in a cylinder 31 formed in the first arm 13A. The piston 33 is opposed to the lock pin 45, that is, the piston 33 is located in alignment with the lock pin 45, so that the piston 33 bears against one end of the lock pin 45 at the contact surface 36 between the first and second arms when the rocker arm 11 is in the inoperative position, i.e., when the lock pin 45 is in the unlocked position. In this manner, the second arm 13B can rotate about the shaft 15 relative to the first arm 13A in the unlocked position.

The cylinder 31 is hydraulically connected to a bore 20 of the hollow rocker arm shaft 19 through an oil passage 16 formed in the first arm 13A. The bore 20 of the rocker arm shaft 19 is hydraulically connected to an oil supply unit 50 having an oil pump P, etc., through a switching valve 60, which selectively cuts the supply of the pressurized oil to the bore 20. Namely, the switching valve 60 operates in response to, for example, a signal S representing an engine load, to feed the pressurized oil from the oil unit 50 to the rocker arm shaft or to return the pressurized oil to a drain. The switching valve can be, for example, a conventional electromagnetic two-way valve, known per se.

A working fluid other than oil, such as air, water, etc. can be utilized.

When the lock pin 45 is in the locked position, the pressurized oil in the bore 20 is released, and accordingly, the lock pin 45 is pushed by the spring 43 to push the piston 33 into the cylinder 31, so that the lock pin 45 enters a recess 48 coaxial to the cylinder 31 formed in the first arm 13A. As a result of the entrance of the lock pin 45 into the recess 48, the lock pin 45 renders the first and second arms 13A and 13B integral, so that relative rotation can no longer take place between the first and second arms. Namely, the two arms are locked.

It will be appreciated that the piston 33 has a shoulder 33*a* which prevents the front end of the piston 33 from projecting outward from the contact surface 36 toward the lock pin 45, when the piston 33 is pushed by the pressurized oil in the cylinder 31 toward the lock pin 45.

Preferably, the lock pin 45, the blind hole 41 receiving the lock pin, the cylinder 31, and the piston 33 all extend in the same direction X—X (FIG. 3) perpendicular to the axis Y—Y (FIG. 2) of the connecting shaft 15. Namely, the direction of movement of the lock pin 45 and the piston 33, i.e., the direction of action of the force is perpendicularly across the longitudinal axis of the shaft 15. With this arrangement, since the force is exerted on the lock pin 45 or piston 33 in the direction perpendicular to the axis of the shaft 15, both when the rocker arm 11 is locked and when it is unlocked, a force causing the first and second arms 13A and 13B to separate from one another is not exerted on the two arms.

According to one aspect of the present invention, the second arm 13B has an upper surface 89 (i.e., a contact surface) which is raised by the height h in comparison with an upper surface 88 of the first arm 13A, as can be seen from FIG. 4.

With this arrangement, the cam 23 continuously bears only against the upper surface 89 of the second arm 13B, which in turn bears against the valve stem 21, when the rocker arm 11 is in the operative position in which the two arms 13A and 13B are integrally locked. This results in a direct transmission of the force of the cam to the second arm 13B, and accordingly, the valve stem 21.

Furthermore, according to the present invention, the upper surface 88 of the first arm 13A is provided with a recess 65 corresponding to the cam lobe 24 of the cam 23. The recess 65 prevents the upper surface 88 of the first arm 13A from coming into contact with the cam lobe 24 when the second arm 13B is inclined with respect to the first arm 13A in the unlocked position. Namely, the cam 23 bears only against the second arm 13B when the rocker arm is in the operative position, in which the two arms 13A and 13B are integrally locked, since the second arm has the raised upper surface 89, as mentioned above. It should be noted that the cam has a width in the direction of the cam axis spreading over the width w (FIG. 2) of the rocker arm 11. Therefore, the cam 23 would come into partial contact also with the upper surface 88 of the first arm 13A when the second arm 13B is inclined with respect to the first arm 13A in the unlocked position, if a recess was not provided on the upper surface 88 of the first arm 13A.

The recess 65 contributes to elimination of such a partial contact between the cam lobe 24 and the upper surface of the first arm 13A.

In this manner, according to the present invention, since the cam bears only against one of the two arms that bears against the valve stem, i.e., the second arm 13B in the illustrated embodiments, the stress applied to the connecting shaft 15 can be decreased, resulting in a decrease of the diameter of the connecting shaft and also in a decrease of the frictional wear thereof. By the direct transmission of the cam lift only to the second shaft, a possibility of the production of play between the connecting shaft 15 and the rocker arm 11 also can be decreased. The decreased diameter of the connecting shaft contributes to an increased sectional area of the rocker arm, resulting in an increase of the strength thereof.

Furthermore, the recess provided on the upper surface of one of the arms having no direct relationship to the movement of the valve stem can decrease frictional wear of the arm without the need for a particular and expensive surface treatment, such as hardening. According to another aspect of the present invention, there is provided a predetermined distance d between the axis of the connecting shaft 15 and the axis of the cam shaft 25, as shown in FIG. 3, to prevent interference between the first arm 13A and the retainer 12 of an adjacent valve unit including the valve stem 21, the return spring 14, the retainer 12, etc. This interference will be described below in detail with reference to FIGS. 8 and 9.

Figure 8:
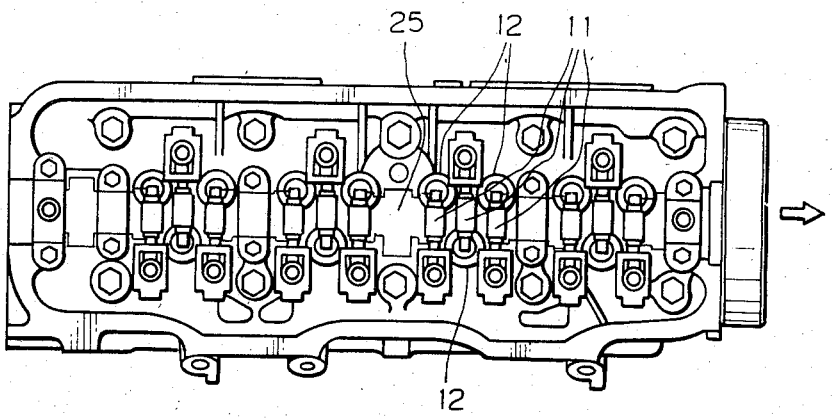
FIG. 8 is a plan view of a multi-cylinder engine having three valves for each cylinder, to which the present invention can be adapted.
Figure 9:
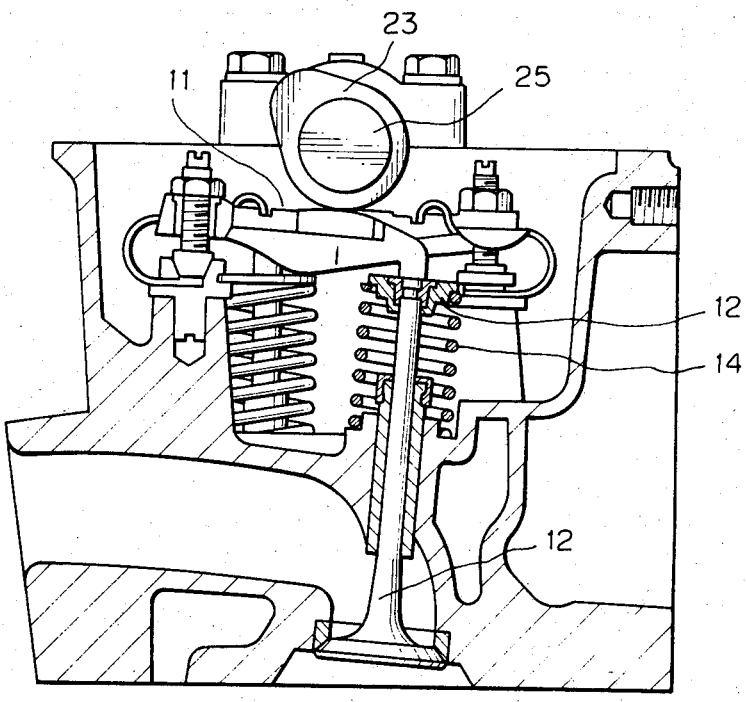
FIG. 9 is a partial sectional side elevational view of a main part of the arrangement shown in FIG. 8.

FIGS. 8 and 9 show a typical layout of a multicylinder engine having three valves (intake and exhaust valves) for each cylinder. In FIG. 8, the front side is designated by an arrow. As is well known, three retainers 12 of three valves of each cylinder are located along the cam shaft 25 and on the opposite sides thereof in a zigzag fashion, so that very small gaps are provided between the rocker arm 11 of a valve unit and the retainer 12 of an adjacent valve unit. Because of this small gap, when the rocker arm 11 occupies the inoperative position in which the relative inclination takes place between the two arms of the rocker arm, there is a possibility that the front end 103 (FIG. 1) of the inclined first arm 13A will interfere with the retainer of an adjacent valve unit. This interference can be eliminated by decreasing the angular displacement of the first arm 13A. The decreased angular displacement of the first arm can be achieved by the deviation represented by the distance d mentioned above. The longitudinal axis of the connecting shaft 15 lies in a vertical plane, which is spaced by the distance d from a vertical plane which includes the longitudinal axis Z—Z of the cam shaft 25 toward the valve stem, i.e., toward the second arm 13B.

In the prior art, the axis of the connecting shaft 15 substantially lies in the vertical plane including the axis Z—Z of the cam shaft 25.

The larger the distance d, the smaller the angular displacement of the first arm 13A with respect to the rocker arm shaft 19. Namely, the angular displacement of the first arm 13A decreases as the connecting shaft 15 comes closer to the free end of the second arm 13B. It will be easily understood that, when the center of the connecting shaft 15 comes into alignment with an extension of the longitudinal axis of the valve stem 21, the angular displacement becomes zero. It should be noted that even when the angular displacement of the first arm 13A is zero, the angular displacement of the second arm 13B does not vary; that is, a predetermined necessary displacement of the valve stem to open the associated valve is ensured. In other words, the angular displacement of the second arm 13B does not depend on the location of the connecting shaft 15 and is constant.

The distance d causes the cam 23 to tend to come into contact with the upper surface 88 of the first arm 13A. This tendency can be eliminated by the provision of the recess 65 on the upper surface 88 of the first arm 13A. Namely, when the lock of the rocker arm 11 is released, the second arm 13B is inclined by the cam lobe 24 of the cam 23 and the inclination is then transmitted to the first arm 13A through the connecting shaft 15, so that the first arm 13A rotates about the rocker arm shaft 19.

The deviation of the distance d is effective because the first arm 13A is not directly rotated by the cam lobe 24 of the cam 23.

Figure 5:
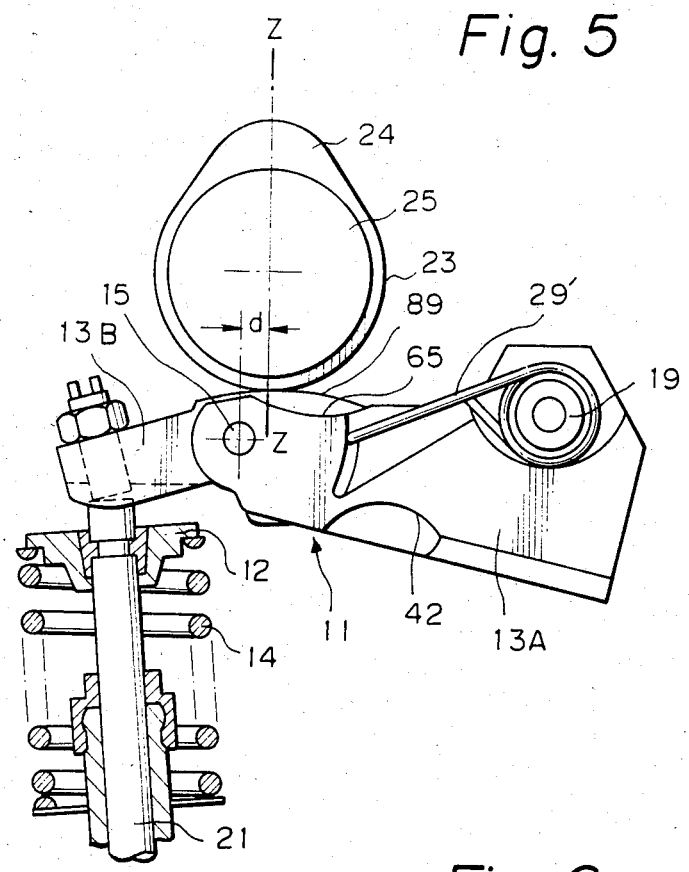
FIG. 5 is a side elevational view of a valve actuating apparatus shown in a locked position, according to a second embodiment of the present invention.

It is also possible to provide a recess 42 on the portion of a lower surface of the first arm 13A that may interfere with a valve retainer 12 of an adjacent valve unit, as shown in FIG. 5.

The apparatus of the present invention operates as follows. First, in the lock position of the lock pin 45, i.e., in the operative position of the rocker arm 11, shown in FIGS. 3 and 4, the cylinder 31 is released from the pressurized oil and accordingly, lock pin 45 forces the piston 33 into the cylinder and partially enters the recess 48, as mentioned before. Therefore, the two arms 13A and 13B are integral with each other and, accordingly, the rocker arm 11 operates in the same fashion as the conventional single rocker arm. Namely, when the intake or exhaust valve (not shown) is made open, the cam lobe 24 of the cam 23 causes the valve stem 21 to move downward in accordance with the cam lift, by means of the rocker arm 11, as shown in FIG. 4, to open the associated valve. When the cam lobe 24 comes away from the rocker arm 11 during the rotation of the cam, the valve stem 21 is moved upwards by the spring 14 to close the associated valve.

When, for example, it is desired to make a predetermined intake or exhaust valve inoperative at a predetermined engine load, the pressurized oil is fed to the cylinder 31 from the oil supply unit 50, so that the piston 33 forces the lock pin 45 into the blind hole 41 against the spring 43 to release the lock. Thus, the rocker arm 11 is unlocked, and the two arms 13A and 13B of the rocker arm 11 can rotate relative to each other. Accordingly, when the rocker arm 11 is pushed down by the cam lobe 24, the second arm 13B rotates about the shaft 15 and is inclined relative to the first arm 13A which in turn rotates slightly about the rocker arm shaft 19 to absorb the cam lift of the cam 23. In this manner, in spite of continuation of the rotation of the cam 23, the cam effect is cancelled out and is not transmitted to the valve stem 21, so that the associated intake or exhaust valve remains inoperative, i.e., remains closed. It should be noted that when the rocker arm 11 is in the unlocked position shown in FIG. 1, the lock pin 45 separates from the piston 33, but is still kept in an unlocked state by the curved contact surface 36 of the first arm 13A. The rocker arm 11 can be returned to the straight position identical to the operative position, in which the two arms 13A and 13B extend substantially straight, by means of the return spring 29 every time the cam lobe 24 comes away from the rocker arm 11.

Figure 6:
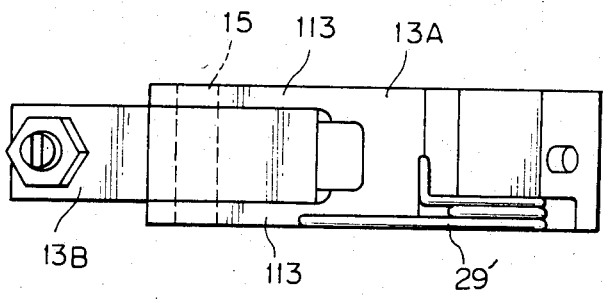
FIG. 6 is a plan view of FIG. 5.
Figure 7:
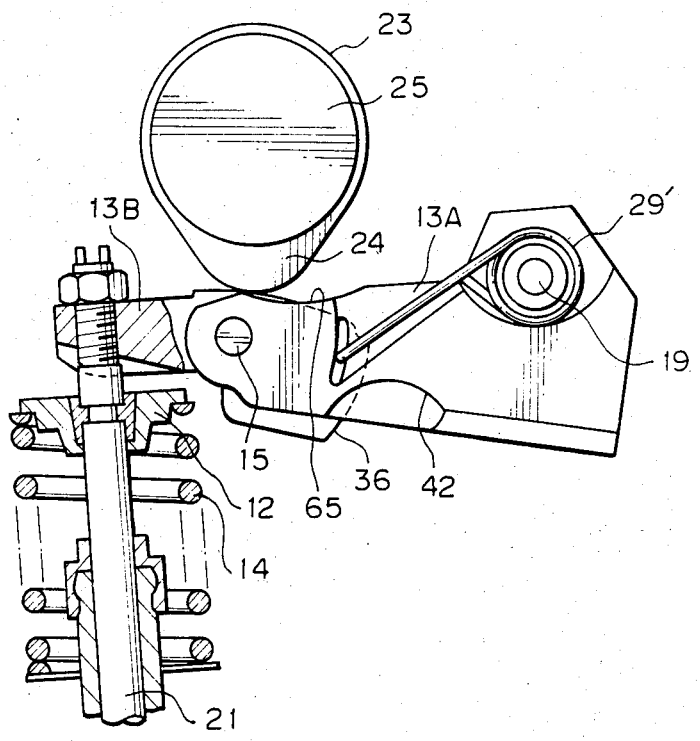
FIG. 7 is a view similar to FIG. 5 but shown in an unlocked position.

FIGS. 5 to 7 show another embodiment of the present invention.

In the arrangement illustrated in FIGS. 5 to 7, the second arm 13B is slidably and rotatably held in bifurcated ends 113 (FIG. 6) of the first arm 13A. Note that the arrangements shown in FIGS. 5 and 7 are viewed as a reverse of the arrangements of FIGS. 1 to 4. In FIG. 5, the return spring 29 in FIGS. 1 to 4 is replaced by a coil return spring 29′ provided on the rocker arm shaft 19. The coil spring 29′ bears against the first arm 13A at one end and the second arm at the opposite end, respectively.

The recesses 65 are provided on the upper surfaces of both the bifurcated ends 113.

The elements in FIGS. 5 to 7 corresponding to those of the first embodiment are designated by the same reference numerals as those in FIGS. 1 to 4.

The operation of the apparatus shown in FIGS. 5 to 7 is fundamentally identical to that of the first embodiment mentioned above.

I claim:

1. A valve actuating apparatus for intake and exhaust valves in an internal combustion engine having a swing rocker arm which is rotatably connected at its one end to a rocker arm shaft supporting the rocker arm and at its opposite end bears against a valve stem of an associated intake or exhaust valve, and a rotatable cam which is supported on a cam shaft and which bears against the rocker arm to swing the same about the rocker arm shaft, wherein said rocker arm is composed of two arms which are interconnected to each other by means of a connecting shaft extending in parallel to the rocker arm shaft for relative rotation about the connecting shaft, one of which arms bears against the valve stem, so that the two arms can selectively occupy an operative position in which the two arms are integral with each other and extend substantially straight so as to form a single rocker arm, and an inoperative position in which a relative rotation between the two arms takes place to absorb the rotation of the cam, and wherein said apparatus comprises means for causing the cam to bear only against said one arm bearing against the valve stem.

2. An apparatus according to claim 1, wherein said means comprises a raised surface portion which is provided on said one arm bearing against the valve stem and on which the cam continuously bears.

3. An apparatus according to claim 1, wherein said means comprises a recess which is provided on the other arm of the rocker arms so that contact does not occur between the cam and said the other arm of the rocker arms.

4. An apparatus according to claim 3, wherein said connecting shaft lies in a vertical plane, which is spaced from a vertical plane in which the axis of the camshaft lies, by a predetermined distance so as to come close to the valve stem.

* * * * *